United States Patent [19]

Odajima et al.

[11] Patent Number: 4,890,362

[45] Date of Patent: Jan. 2, 1990

[54] EYELET AND METHOD OF ATTACHING THE SAME

[75] Inventors: Kotoku Odajima; Kazuhiro Sasaki, both of Waga, Japan

[73] Assignee: Morito Co., Ltd., Osaka, Japan

[21] Appl. No.: 289,195

[22] Filed: Dec. 23, 1988

[51] Int. Cl.[4] ..... A43C 5/00

[52] U.S. Cl. ..... 24/713.7; 411/479; 29/509

[58] Field of Search ..... 24/141; 29/509; 411/479

[56] References Cited

U.S. PATENT DOCUMENTS

| | | | |
|---|---|---|---|
| 2,087,969 | 7/1937 | Gookin | 24/141 |
| 2,143,087 | 1/1939 | Rau | 24/141 |
| 3,399,435 | 9/1968 | Ackerman, Jr. | 24/141 |

FOREIGN PATENT DOCUMENTS

| | | | |
|---|---|---|---|
| 526333 | 6/1931 | Fed. Rep. of Germany | 24/141 |
| 343185 | 9/1904 | France | 24/141 |
| 9696 | of 1888 | United Kingdom | 24/141 |
| 737259 | 9/1955 | United Kingdom | 24/141 |

*Primary Examiner*—Victor N. Sakran
*Attorney, Agent, or Firm*—Roger J. French

[57] ABSTRACT

An eyelet having a seat and an eyelet body. The seat has a central hole formed of a tapered cylindrical portion extending and narrowing in the opposite direction of insertion, a curved annular crest extending in the inserting direction from the cylindrical portion, a curved annular trough extending from the annular crest, and a flat portion extending from the annular trough. The eyelet body has a annular flat base and a tapered cylindrical portion extending from the flat base and narrowing in the inserting direciton. The cylindrical portion has a continuous edge which is sharpened to stamp out a sheet to which the eyelet is attached.

2 Claims, 2 Drawing Sheets

EYELET AND METHOD OF ATTACHING THE SAME

FIELD OF THE INVENTION

This invention relates to an eyelet, especially a comparatively large eyelet and a method of attaching it to a canvas and the like. Such an eyelet is used for inserting a rope in the center hole thereof, or connecting it with a locking member in canvas and bags. It is also used in garment as an accessory.

Heretofore, eyelets have been used in a canvas of a truck or a tent as a connecting means. The most common type of such eyelets is shown in FIGS. 4 and 5. It comprises a seat member b having a central hole a and an eyelet body d having a projected cylindrical portion c. The seat member b and the eyelet body d are combined by inserting the cylindrical portion c of the eyelet body d into the central hole a of the seat member b, and then bending the tip of the cylindrical portion c outside so that the peripheral part thereof may firmly engage with the seat member b. A canvas e having a hole f is sandwiched between these two elements.

One of the drawbacks of this eyelet, especially when used in a bag, is that the bent portion of the eyelet body d gives an uncomfortable feeling, in a worse case, scratches, to a finger or other parts of the human body.

SUMMARY OF THE INVENTION

With the foregoing in mind, it is an object of the present invention to eliminate the disadvantage of the prior art and to provide an improved eyelet having no dangerous bent portion.

Another object of this invention is to provide a new method of attaching the eyelet to a sheet member, for example, a canvas.

The eyelet according to this invention comprises a seat member having a central hole made of a tapered cylindrical portion extending and narrowing in the opposite direction of insertion, a curved annular crest extending in the inserting direction from the cylindrical portion, a curved annular trough extending from the annular crest, and a flat portion extending from the annular trough, and an eyelet body having a annular flat base and a tapered cylindrical portion extending from the flat base and narrowing in the inserting direction, an edge of the cylindrical portion being sharp enough to stamp out a sheet member to which the eyelet is attached.

The method of attaching an eyelet to a sheet member comprises the steps of placing a seat member having a central hole made of a tapered cylindrical portion extending and narrowing in the opposite direction of insertion, a curved annular crest extending in the inserting direction from the cylindrical portion, a curved annular trough extending from the annular crest, and a flat portion extending from the annular trough, on a punching machine lower mold having a recess and an annular groove, covering the seat member with a sheet member to which the eyelet is attached, placing an eyelet body having an annular flat base and a tapered cylindrical portion extending from the flat base and narrowing in the inserting direction, an edge of the cylindrical portion being sharp enough to stamp out a sheet to which the eyelet is attached, on the seat member and the sheet, and punching the seat member and the eyelet body via the sheet member with a punching machine upper mold having a recess, thereby the sharp edge of the eyelet body stamping out the sheet member and the cylindrical portion of the eyelet body sliding down along the tapered portion of the seat body, a front part of the eyelet body including the sharp edge exceeding over a tip of the tapered portion, contacting a wall of the groove of the lower mold and then being bent inward by the groove wall so as to enclose the tip of the seat member.

BRIEF DESCRIPTION OF THE DRAWINGS

Other objects and advantages will appear as the description proceeds when taken in connection with accompanying drawings, in which.

DESCRIPTION OF THE ILLUSTRATED EMBODIMENT

Figure 1:
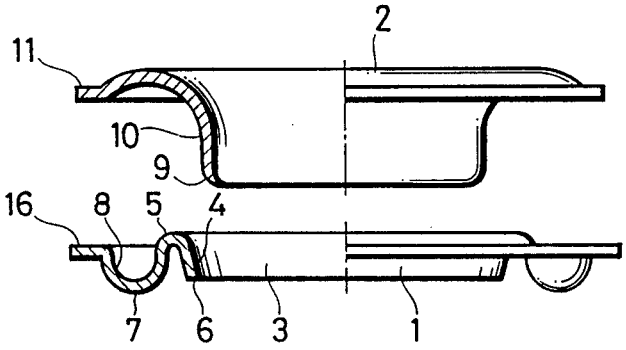
FIG. 1 is a side view, partially shown in section, of a seat member and an eyelet body in a separated position.

As illustrated in FIG. 1, the eyelet according to this invention comprises a seat member 1 and an eyelet body 2, which are combined when in use.

The seat member 1 is generally ringed and has a central hole 3 therein. The hole 3 is made of a tapered cylindrical portion 4 extending and narrowing in the opposite direction of insertion, the tip of the tapered portion 4 being indicated by 6. At the front of the inserting direction of the tapered portion 4 is a curved annular crest 5, and from there, extends a curved annular trough 8, the bottom being indicated by 7, and a flat portion 16.

The eyelet body 2 comprises a ringed flat base 11 and a tapered cylindrical portion 10 extending from the flat base 11 and narrowing in the inserting direction. The edge 9 of the cylindrical portion 10 is sharp enough to stamp out a canvas.

Figure 2:
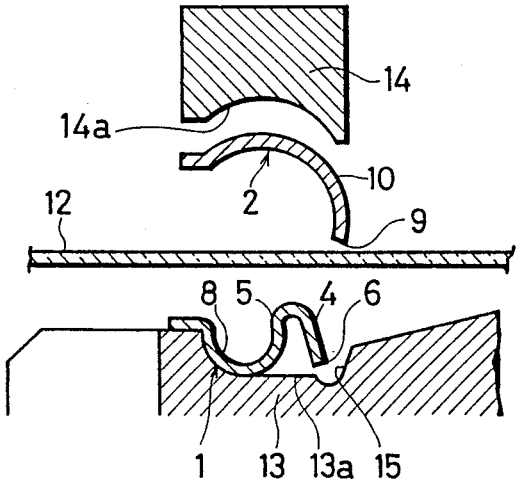
FIG. 2 is a sectional view showing a state before combining the two elements.
Figure 3:
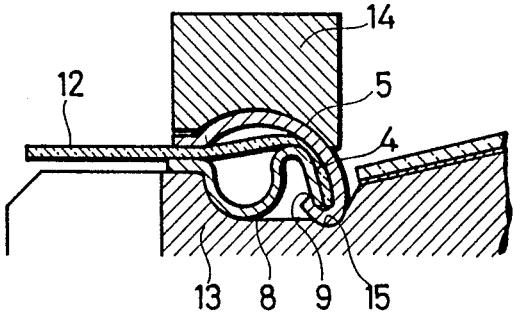
FIG. 3 is a sectional view showing a state after combining the two elements.
Figure 4:
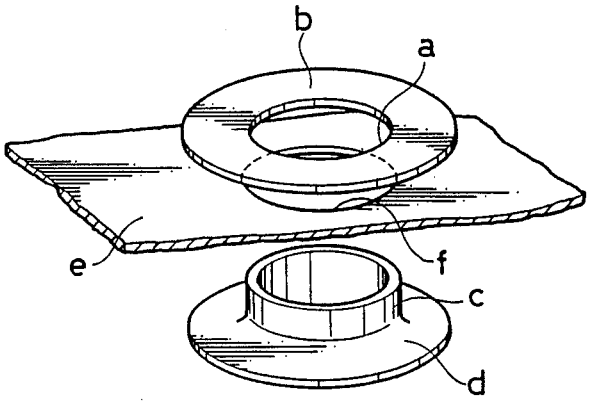
FIG.4 PRIOR ART
FIG. 4 is a perspective view of a conventional eyelet in a separated position.
Figure 5:
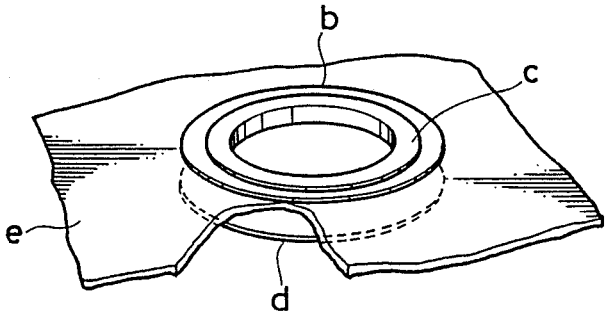
FIG.5 PRIOR ART
FIG. 5 is a perspective view of the conventional eyelet in a combined position.

The combining process of the two elements will now be described with reference to FIGS. 2 and 3. For clarity's sake, only a fragmentary section is shown here, but it should be understood that the same section extends annularly. In these drawings, numeral 12 denotes a canvas to which the eyelet is attached, 13 and 14 are upper and lower molds, respectively, of a punching machine. The upper mold 14 has a recess **14*a* in the complementary shape of the cylindrical portion 10 of the seat body 2. The lower mold 13 has also a recess 13*a* and a annular groove 15 in the recess 13*a***.

First, the seat member 1 is placed in the recess **13*a* of lower mold 13, and the canvas 12 is placed thereon. Then the eyelet body 2 is pressed against the seat body 2 with the upper mold 14. The sharp edge 9 of the eyelet body 2 stamps out the canvas 12 and cylindrical portion 10 slides down along the tapered portion 4 of the seat body 1. The front part of the eyelet body 2 including the sharp edge 9 exceeds over the tip 6 of the tapered portion 4, contacts the wall of the groove 15 and then is bent inward by the groove wall so as to enclose the tip 6 of the seat member 1**.

The eyelet body 2 and the seat member 1 are thus firmly combined, and the canvas 12 is strongly caught between the cylindrical portion 10 and the curved crest 5. In the combined state, the sharp edge 9 of the eyelet body 2, which is dangerous if exposed, is drawn inside toward the curved crest 5 and the tip 6 of the seat member 1 is enclosed by the front portion of the cylindrical portion 10. It should be noted here that, unlike the prior art method of attaching eyelets, the present method does not require a step of perforating the canvas in advance before attaching the eyelet.

The foregoing relates to only a preferred embodiment of the invention and that it is intended to cover all changes and modifications of the example of the invention herein chosen for the purpose of disclosure, the scope of the invention being defined in the claims.

We claim:

1. An eyelet comprising: a seat member having a central hole made of a tapered cylindrical portion extending and narrowing in the opposite direction of insertion, a curved annular crest extending in the inserting direction from the cylindrical portion, a curved annular trough extending from the annular crest, and a flat portion extending from the annular trough, and an eyelet body having an annular flat base and a tapered cylindrical portion extending from the flat base and narrowing in the inserting direction, a continuous edge of the cylindrical portion being sharp to stamp out a sheet member to which the eyelet is attached.

2. A method of attaching an eyelet to a sheet member comprising the steps of:

placing a seat member having a central hole made of a tapered cylindrical portion extending and narrowing in the opposite direction of insertion, a curved annular crest extending in the inserting direction from the cylindrical portion, a curved annular trough extending from the annular crest, and a flat portion extending from the annular trough, on a punching machine lower mold having a recess and an annular groove, covering the seat member with a sheet member to which the eyelet is attached, placing an eyelet body having an annular flat base and a tapered cylindrical portion extending from the flat base and narrowing in the inserting direction, an edge of the cylindrical portion being sharp enough to stamp out a sheet to which the eyelet is attached, on the seat member and the sheet, and punching the seat member and the eyelet body via the sheet member with a punching machine upper mold having a recess, thereby the sharp edge of the eyelet body stamping out the sheet member and the cylindrical portion of the eyelet body sliding down along the tapered portion of the seat body, a front part of the eyelet body including the sharp edge exceeding over a tip of the tapered portion, contacting a wall of the groove of the lower mold and then being bent inward by the groove wall so as to enclose the tip of the seat member.

* * * * *